US009145778B2

(12) United States Patent
Kim et al.

(10) Patent No.: US 9,145,778 B2
(45) Date of Patent: Sep. 29, 2015

(54) COMBUSTOR WITH NON-CIRCULAR HEAD END

(75) Inventors: Won-Wook Kim, Simpsonville, SC (US); Kevin Weston McMahan, Greer, SC (US)

(73) Assignee: General Electric Company, Schenectady, NY (US)

( * ) Notice: Subject to any disclaimer, the term of this patent is extended or adjusted under 35 U.S.C. 154(b) by 769 days.

(21) Appl. No.: 13/437,954

(22) Filed: Apr. 3, 2012

(65) Prior Publication Data

US 2013/0255262 A1 Oct. 3, 2013

(51) Int. Cl.

*F23C 5/08* (2006.01)
*F01D 9/02* (2006.01)
*F23R 3/46* (2006.01)

(52) U.S. Cl.

CPC . *F01D 9/023* (2013.01); *F23C 5/08* (2013.01); *F23R 3/46* (2013.01); *F05D 2250/14* (2013.01); *F23R 2900/00014* (2013.01)

(58) Field of Classification Search

CPC ..... F01D 9/023; F23R 3/46; F23C 5/08; F05D 2250/14
USPC ..... 60/39.37, 752–760
See application file for complete search history.

(56) References Cited

U.S. PATENT DOCUMENTS

| | | | | |
|---|---|---|---|---|
| 2,797,549 | A * | 7/1957 | Probert | 60/39.23 |
| 2,828,608 | A * | 4/1958 | Cowlin | 60/799 |
| 4,719,748 | A * | 1/1988 | Davis et al. | 60/39.37 |
| H1008 | H * | 1/1992 | Schadow et al. | 60/737 |
| 5,351,475 | A | 10/1994 | Ansart et al. | |
| 7,007,486 | B2 * | 3/2006 | Sprouse et al. | 60/776 |
| 7,082,766 | B1 * | 8/2006 | Widener et al. | 60/752 |
| 7,111,463 | B2 * | 9/2006 | Sprouse et al. | 60/776 |
| 7,721,547 | B2 * | 5/2010 | Bancalari et al. | 60/752 |
| 7,942,005 | B2 * | 5/2011 | Bessagnet et al. | 60/752 |
| 8,297,037 | B2 * | 10/2012 | Nakamura et al. | 60/39.37 |
| 8,607,451 | B2 * | 12/2013 | Arase et al. | 29/889.1 |
| 2010/0170257 | A1 | 7/2010 | Chila et al. | |
| 2010/0205972 | A1 | 8/2010 | Chila et al. | |
| 2010/0218502 | A1 | 9/2010 | Chila et al. | |
| 2010/0257863 | A1 | 10/2010 | Chila et al. | |
| 2011/0000080 | A1 * | 1/2011 | Arase et al. | 29/700 |
| 2011/0016865 | A1 * | 1/2011 | Nakamura et al. | 60/722 |
| 2011/0247341 | A1 | 10/2011 | McMahan et al. | |
| 2011/0259015 | A1 * | 10/2011 | Johns et al. | 60/39.37 |
| 2014/0137535 | A1 * | 5/2014 | Kim et al. | 60/39.37 |

FOREIGN PATENT DOCUMENTS

| | | | |
|---|---|---|---|
| DE | 768019 | C | 5/1955 |
| DE | 1223622 | B | 8/1966 |

OTHER PUBLICATIONS

EP Search Report and Written Opinion dated Dec. 13, 2013, issued in connection with corresponding EP Patent Application No. 13152858.0.

* cited by examiner

*Primary Examiner* — Phutthiwat Wongwian
*Assistant Examiner* — Lorne Meade
(74) *Attorney, Agent, or Firm* — Sutherland Asbill & Brennan LLP

(57) ABSTRACT

The present application provides a combustor for use with a gas turbine engine. The combustor may include a head end with a non-circular configuration, a number of fuel nozzles positioned about the head end, and a transition piece extending downstream of the head end.

12 Claims, 2 Drawing Sheets

COMBUSTOR WITH NON-CIRCULAR HEAD END

This invention was made with government support under Contract No. DE-FC26-05NT42643 awarded by the U.S. Department of Energy. The Government has certain rights in this invention.

TECHNICAL FIELD

The present application and the resultant patent relate generally to gas turbine engines and more particularly relate to a can combustor with a substantially non-circular head end.

BACKGROUND OF THE INVENTION

Generally described, industrial gas turbine combustors are designed with a number of discrete combustion chambers or "cans" arranged in an array around the circumference of a first stage of a turbine. The combustor cans ignite a fuel/air mixture such that the resultant hot combustion gases drive a downstream turbine. The major components of an industrial gas turbine can-type combustor may include a cylindrical or cone-shaped sheet metal liner engaging the round head end of the combustor and a sheet metal transition piece that transitions the flow of hot combustion gases from the round cross-section of the liner to an arc-shaped inlet to a first stage of the turbine. These and other components positioned about the hot gas path may be cooled by a flow of air through an impingement sleeve and the like.

Efficient operation of a can combustor thus requires efficient cooling, efficient transition of the flow of hot combustion gases from the combustor to the first stage of the turbine with low pressure losses, and efficiency in other types of operational parameters. Can combustor design thus seeks to optimize these parameters for increase output and overall performance.

SUMMARY OF THE INVENTION

The present application and the resultant patent thus a combustor for use with a gas turbine engine. The combustor may include a head end with a non-circular configuration, a number of fuel nozzles positioned about the head end, and a transition piece extending downstream of the head end.

The present application and the resultant patent further provide a can combustor for use with a gas turbine engine. The combustor may include a non-circular head end, a number of fuel nozzles positioned about the non-circular head end, and an integrated piece extending downstream of the non-circular head end.

The present application and the resultant patent further provide a one-piece can combustor for use with a gas turbine engine. The combustor may include a head end with a non-circular configuration, a number of fuel nozzles positioned about the head end, an aft end, an integrated piece extending downstream of the head end to the aft end, and a turbine stage positioned about the aft end.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
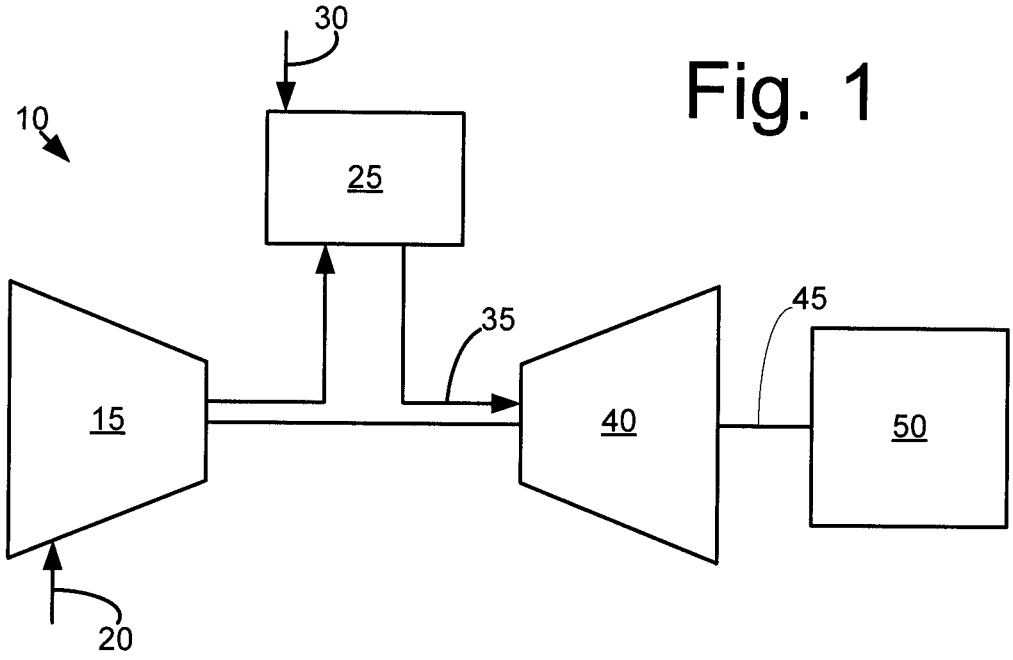
FIG. 1 is a schematic diagram of a gas turbine engine with a compressor, a combustor, and a turbine.

Referring now to the drawings, in which like numerals refer to like elements throughout the several views, FIG. 1 shows a schematic diagram of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of hot combustion gases 35. Although only a single combustor 25 is shown, the gas turbine engine 10 may include any number of combustors 25. The flow of the hot combustion gases 35 is in turn delivered to a turbine 40. The flow of the hot combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, New York and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
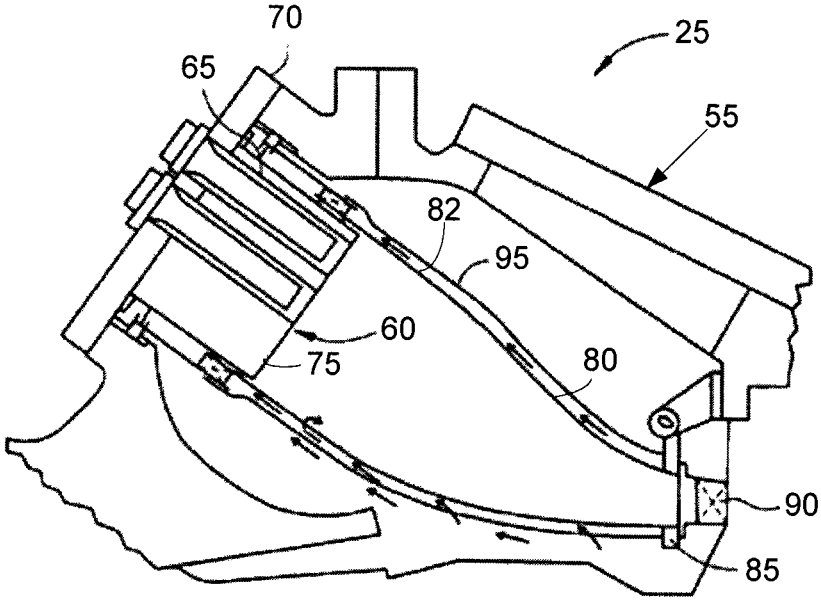
FIG. 2 is a schematic diagram of a combustor as may be used with the gas turbine engine of FIG. 1.

FIG. 2 shows an example of the combustor 25 that may be used with the gas turbine engine 10. In this example, the combustor 25 may be a conventional can combustor 55. The can combustor 55 may include a head end 60 with a number of fuel nozzles 65 positioned between an end cover 70 and a circular cap 75. A transition piece 80 and a liner 82 may be attached to each other and may extend from the circular cap 75 to an aft end 85 near a first stage nozzle vane 90 of the turbine 40. An impingement sleeve 95 may surround the transition piece 80 and the liner 82 to provide a cooling flow of air thereto. Other types of combustors 25 with other types of components and other configurations also are known.

Figure 3:
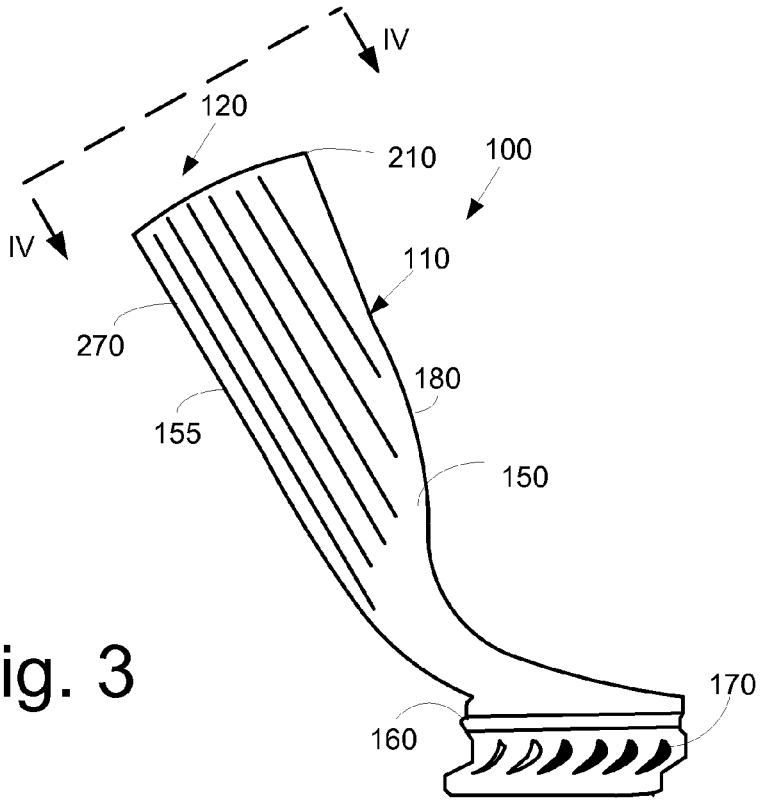
FIG. 3 is a partial perspective view of a portion of a one piece combustor as may be described herein.
Figure 4:
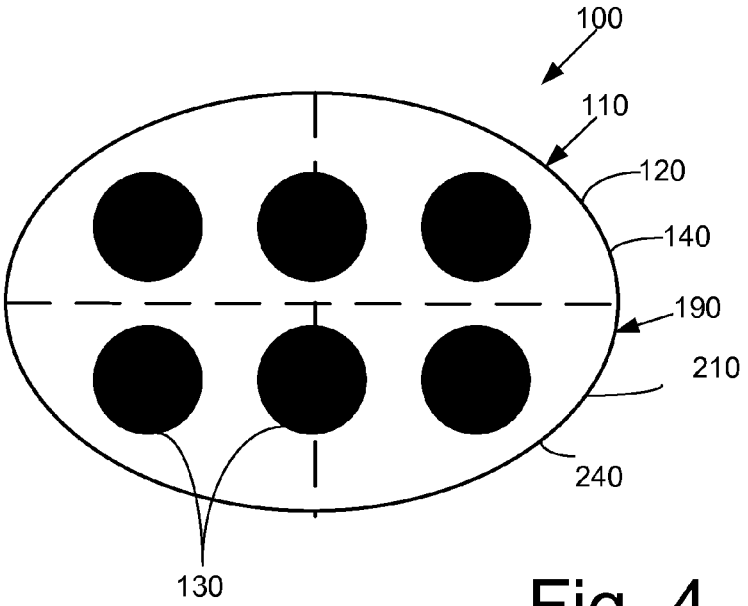
FIG. 4 is a partial sectional view of a non-circular head end of the one piece combustor of FIG. 3.

FIG. 3 and FIG. 4 show a portion of a combustor 100 as may be described herein. As above, the combustor 100 may be a one-piece can combustor 110 with the integrated configuration of the transition piece 80, the liner 82, and the first stage nozzle vane 90. Other types of combustors 100 may be used herein with other components and other configurations.

The can combustor 110 may include a head end 120. A number of fuel nozzles 130 may extend from an end cover (not shown) to a cap 140. The can combustor 110 also may include an integrated piece 150. As described above, the integrated piece 150 may include the liner, the transition piece, and the first stage nozzle. The integrated piece 150 may extend from the head end 120 to an aft end 160 about a first stage bucket blade 170 of the turbine 40 and the like. An impingement sleeve 180 may surround the integrated piece 150 so as to provide a flow of cooling air thereto from the compressor 15 or elsewhere. Other components and other configurations also may be used herein.

The head end 120 may have a substantially non-circular configuration 190. The non-circular configuration 190 is not limited to any particular shape. The head end 120 thus may be an oval head end, an elliptical head end 210, or any type of substantially non-circular head end. Similarly, the cap 140 also may have the non-circular configurations 190. As a result, the cap 140 may be an oval cap, an elliptical cap 240, or any type of substantially non-circular cap. Likewise, a transition piece 155 of the integrated piece 150 about the head end 120 also may have the non-circular configuration 190 before transitioning into any other shape. As a result, an oval transition piece, an elliptical transition piece 270, or any type of substantially non-circular transition piece may be used herein. Other components and other configurations also may be used herein.

The can combustor 110 with the head end 120 having the non-circular configuration 190 thus promotes a more efficient transition of the flow of hot combustion gases 35 to the first stage bucket 170 of the turbine 40 with lower total pressure losses. A more efficient transition of the flow 35 may be provided by tailoring the cross-sectional shape of the head end 120 with the non-circular configuration 190. Transverse mode of combustion dynamics may be mitigated with the non-circular configuration 190. The non-circular configuration 190 also may provide an additional approach to optimizing front end mixing for improved emissions, combustion dynamics, and combustion exit temperature profiles. Specifically, front end mixing may be optimized by changing the location and flow direction of each of the flow nozzles 130 relative to the non-circular configuration 190 of the head end 120. The combustion exit temperature profile may be further optimized by clocking the non-circular configuration 190 of the head end 120 relative to the nozzle exit plain.

Although the one-piece can combustor 110 has been used herein, any type of combustor 100 may be applicable to the non-circular configuration 190 of the head end 120 and other components. The non-circular configuration 190 is not limited to any particular shape.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A combustor for use with a gas turbine engine, comprising:

an elliptical head end positioned at a first end of the combustor, the elliptical head end having an elliptical cross-sectional geometry with a major axis and a minor axis;

a plurality of fuel nozzles positioned within the elliptical head end at the first end of the combustor;

a transition piece extending downstream of the elliptical head end, the transition piece comprising the elliptical cross-sectional geometry at a first transition piece end and a non-circular configuration at a second transition piece end, the non-circular configuration is different than the elliptical cross-sectional geometry; and the plurality of fuel nozzles comprises an arrangement of at least 4 fuel nozzles arranged in an array parallel to the major axis of the elliptical cross-sectional geometry.

2. The combustor of claim 1, wherein the combustor comprises a can combustor.

3. The combustor of claim 1, wherein the plurality of fuel nozzles are positioned within a cap about the elliptical head end.

4. The combustor of claim 3, wherein the cap comprises an elliptical cap.

5. The combustor of claim 1, wherein the transition piece comprises an elliptical transition piece.

6. The combustor of claim 1, wherein the second transition piece end is an aft end that comprises the non-circular configuration.

7. The combustor of claim 1, wherein the transition piece extends to a turbine stage.

8. The combustor of claim 1, further comprising an impingement sleeve surrounding the transition piece.

9. A can combustor for use with a gas turbine engine, comprising:

an elliptical head end positioned at a first end of the combustor, the elliptical head end having an elliptical cross-sectional geometry with a major axis and a minor axis;

a plurality of fuel nozzles positioned within the elliptical head end at the first end of the combustor;

an integrated piece extending downstream of the elliptical head end, the integrated piece comprising an elliptical cross-sectional geometry configured to mate with the elliptical head end, and a non-circular configuration at an aft end of the integrated piece, the non-circular configuration different from the elliptical cross-sectional geometry; and the plurality of fuel nozzles comprises an arrangement of at least 4 fuel nozzles arranged in an array parallel to the major axis of the elliptical cross-sectional geometry, wherein the plurality of fuel nozzles are positioned within an elliptical cap about the elliptical head end.

10. A one-piece can combustor for use with a gas turbine engine, comprising:

an elliptical head end positioned at a first end of the combustor, the elliptical head end having an elliptical cross-sectional geometry with a major axis and a minor axis;

a plurality of fuel nozzles positioned within the elliptical head end at the first end of the combustor;

an aft end;

an integrated piece extending downstream of the elliptical head end to the aft end, the integrated piece comprising the elliptical cross-sectional geometry configured to mate with the elliptical head end, and a non-circular configuration at the aft end, the non-circular configuration different from the elliptical cross-sectional geometry;

a turbine stage positioned about the aft end; and the plurality of fuel nozzles comprises an arrangement of at least 4 fuel nozzles arranged in an array parallel to the major axis of the elliptical cross-sectional geometry.

11. The one-piece can combustor of claim 10, wherein the plurality of fuel nozzles are positioned within a cap about the elliptical head end.

12. The one-piece can combustor of claim 11, wherein the cap comprises an elliptical cap.

* * * * *